US010458196B2

(12) United States Patent
Schultz, Jr. et al.

(10) Patent No.: US 10,458,196 B2
(45) Date of Patent: Oct. 29, 2019

(54) DOWNHOLE CASING PULLING TOOL

(71) Applicant: Weatherford Technology Holdings, LLC, Houston, TX (US)

(72) Inventors: William Allen Schultz, Jr., Cypress, TX (US); David W. Teale, Spring, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 206 days.

(21) Appl. No.: 15/454,921

(22) Filed: Mar. 9, 2017

(65) Prior Publication Data

US 2018/0258734 A1 Sep. 13, 2018

(51) Int. Cl.

| | |
|---|---|
| ***E21B 31/16*** | (2006.01) |
| ***E21B 33/1295*** | (2006.01) |
| ***E21B 29/00*** | (2006.01) |
| ***E21B 33/126*** | (2006.01) |
| *E21B 29/02* | (2006.01) |

(52) U.S. Cl.

CPC ..... *E21B 31/16* (2013.01); *E21B 29/005* (2013.01); *E21B 33/1265* (2013.01); *E21B 33/1295* (2013.01); *E21B 29/02* (2013.01)

(58) Field of Classification Search

CPC .. E21B 33/1265; E21B 31/16; E21B 33/1295; E21B 29/005; E21B 29/02

See application file for complete search history.

(56) References Cited

U.S. PATENT DOCUMENTS

| | | | |
|---|---|---|---|
| 4,550,781 | A | 11/1985 | Kagler, Jr. |
| 5,101,895 | A | 4/1992 | Gilbert |
| 6,056,049 | A | 5/2000 | Davis |
| 6,357,528 | B1 | 3/2002 | Davis et al. |
| 6,629,565 | B2 | 10/2003 | Harrell |
| 7,757,754 | B2 | 7/2010 | McKay |
| 8,403,038 | B2 | 3/2013 | Russell et al. |
| 8,403,061 | B2 | 3/2013 | Russell et al. |
| 8,527,100 | B2 | 9/2013 | Russell et al. |
| 8,869,896 | B2 | 10/2014 | Crow et al. |
| 8,881,818 | B2 | 11/2014 | Crow et al. |
| 8,881,819 | B2 | 11/2014 | Crow et al. |

(Continued)

FOREIGN PATENT DOCUMENTS

| | | |
|---|---|---|
| EP | 0504848 A1 | 9/1992 |
| EP | 2662526 A2 | 11/2013 |

(Continued)

OTHER PUBLICATIONS

PCT International Search Report and Written Opinion dated Jun. 22, 2018, for International Application No. PCT/US2018/021012.

*Primary Examiner* — Michael R Wills, III

(74) *Attorney, Agent, or Firm* — Patterson + Sheridan, LLP

(57) ABSTRACT

A method and apparatus for cutting and pulling a casing string from a well. A downhole casing pulling tool includes a tubular housing having a bore therethrough, a packer assembly configured to isolate an annulus between a casing and the tool, a slip assembly configured to engage the casing, and a piston assembly disposed in the bore of the tubular housing. The piston assembly is configured to operate an actuator, wherein the actuator is configured to operate at least one of the packer assembly and the slip assembly and modify a fluid pressure in the bore of the tubular housing.

25 Claims, 4 Drawing Sheets

(56) References Cited

U.S. PATENT DOCUMENTS

| | | | | |
|---|---|---|---|---|
| 8,893,791 | B2 | 11/2014 | Crow et al. | |
| 8,985,230 | B2 | 3/2015 | Crow et al. | |
| 9,022,117 | B2 * | 5/2015 | Segura | E21B 29/002 166/298 |
| 9,416,635 | B2 | 8/2016 | Hekelaar | |
| 9,464,496 | B2 * | 10/2016 | O'Rourke | E21B 29/005 |
| 10,024,127 | B2 | 7/2018 | Plante et al. | |
| 10,041,322 | B2 | 8/2018 | Braddick | |
| 2010/0006290 | A1 * | 1/2010 | Saylor, III | E21B 31/16 166/298 |
| 2015/0226031 | A1 * | 8/2015 | Hekelaar | E21B 34/10 166/298 |
| 2016/0130901 | A1 | 5/2016 | Coronado et al. | |
| 2018/0216432 | A1 * | 8/2018 | Nelson | E21B 29/002 |

FOREIGN PATENT DOCUMENTS

| | | | |
|---|---|---|---|
| WO | 2011 031164 | A1 | 3/2011 |
| WO | 2013 133718 | A1 | 9/2013 |
| WO | 2017046613 | A1 | 3/2017 |
| WO | 2017182549 | A1 | 10/2017 |
| WO | 2018083473 | A1 | 11/2017 |
| WO | 2018046907 | A1 | 3/2018 |
| WO | 2018069685 | A2 | 4/2018 |
| WO | 2018142122 | A1 | 8/2018 |
| WO | 2018142123 | A1 | 8/2018 |
| WO | 2018203063 | A1 | 11/2018 |
| WO | 2018211284 | A1 | 11/2018 |

* cited by examiner

DOWNHOLE CASING PULLING TOOL

BACKGROUND OF THE INVENTION

Field of the Invention

Embodiments of the present invention generally relate to methods and apparatus for cutting and pulling downhole casing.

Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed, and a section of casing is lowered into the wellbore. An annulus is thus formed between the string of casing and the formation. The casing string is temporarily hung from the surface of the well. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth with the drill string. The drill string is removed. A first string of casing is then run into the wellbore and set in the drilled-out portion of the wellbore, and cement is circulated into the annulus behind the casing string. Next, the well is drilled to a second designated depth, and a second string of casing or liner, is run into the drilled-out portion of the wellbore. If the second string is a liner string, the liner is set at a depth such that the upper portion of the second string of casing overlaps the lower portion of the first string of casing. The liner string may then be fixed, or "hung" off of the existing casing by the use of slips which utilize slip members and cones to frictionally affix the new string of liner in the wellbore. If the second string is a casing string, the casing string may be hung off of a wellhead. This process is typically repeated with additional casing/liner strings until the well has been drilled to total depth. In this manner, wells are typically formed with two or more strings of casing/liner of an ever-decreasing diameter.

Various types of fishing tools are used in wells to retrieve tools, tubulars, casing, or other components that become stuck in a well. In a typical technique, a work string lowers a tool into the well, and an engagement member at the end of the tool engages the stuck component. An upward force on the work string can then dislodge the component.

For example, casing can become stuck in the well and may need to be retrieved. Traditional removal of the stuck casing is done either with pilot milling, pulling the casing free with jarring action, and then steady pulling applied through the work string and the derrick's draw work. Conventional mechanically controlled tools can be problematic to use during high seas. Standard hydraulic operation can be problematic because different components of the tool, such as the casing cutter, operate at different hydraulic forces. The subject matter of the present disclosure is directed to overcoming, or at least reducing the effects of, one or more of the problems set forth above.

SUMMARY OF THE INVENTION

The present invention generally relates to methods and apparatus for cutting and pulling downhole casing.

In one embodiment, a downhole casing pulling tool includes a tubular housing having a bore therethrough, a packer assembly configured to isolate an annulus between a casing and the tool, a slip assembly configured to engage the casing, and a piston assembly disposed in the bore of the tubular housing. The piston assembly is configured to operate an actuator, wherein the actuator is configured to operate at least one of the packer assembly and the slip assembly and modify a fluid pressure in the bore of the tubular housing.

In another embodiment, a method of performing an operation in a casing string includes deploying a tool in the casing string, wherein the tool is connected to a downhole assembly, pumping fluid through a bore of the tool to actuate a piston assembly, modifying a pressure of the fluid using the piston assembly, and operating the downhole assembly using the modified fluid pressure.

In another embodiment, a downhole casing pulling tool includes a tubular mandrel having a bore therethrough and configured to connect to a downhole assembly, a packer assembly configured to isolate an annulus between a casing and the tool, a slip assembly configured to engage the casing, and a piston assembly configured to modify a pressure of fluid in the tubular mandrel

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
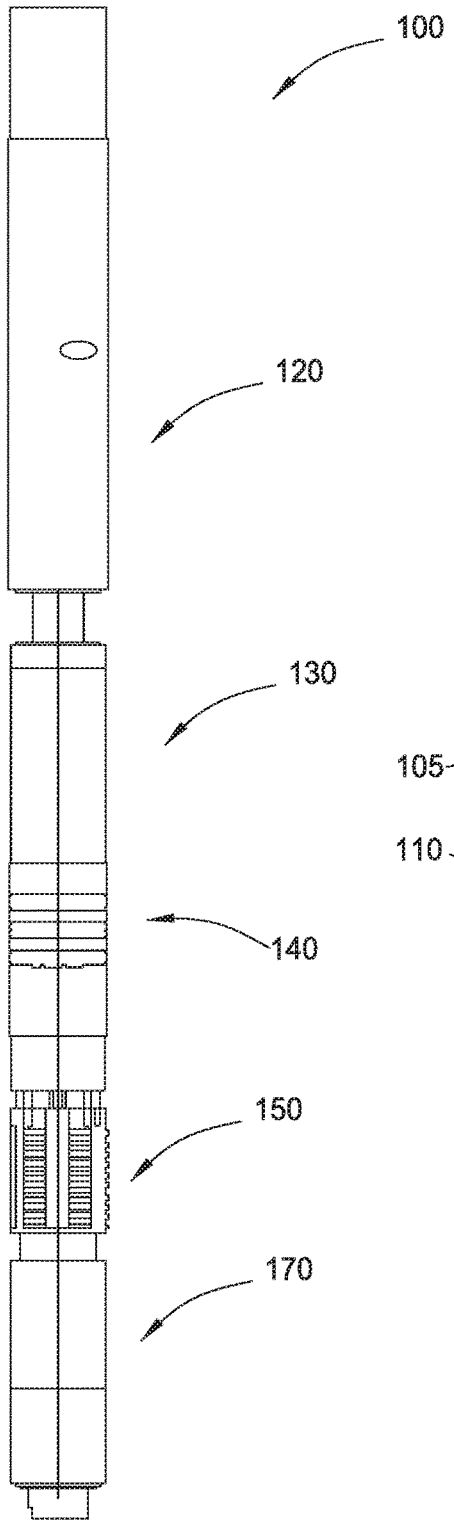
FIG. 1 is an isometric view of a downhole casing tool.
Figure 2:
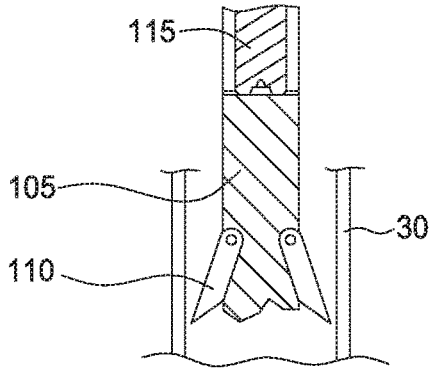
FIG. 2 is a cross sectional view of a downhole assembly configured to connect to the downhole casing tool.

FIG. 1 illustrates a downhole casing pulling tool 100, according to one embodiment of the invention. The downhole casing tool 100 may include a pressure modification assembly (PMA) 120, an actuator 130, a packer assembly 140, a slip assembly 150, and an adapter 170. The work string is used to lower the downhole casing pulling tool 100 into a position within a casing string in the well. The tool 100 may be attached to a downhole assembly, such as a rotary cutter assembly 105 shown in FIG. 2. Alternatively, the downhole assembly may include any tool capable of operating by rotation or hydraulics. The downhole assembly may be used to perform an operation in the well. For example, the downhole assembly may include the rotary cutter assembly 105 for cutting a casing string 30 in the well. The rotary cutter assembly 105 may be actuated by rotation of the work string at the rig. Rotation of the work string may be performed by a top drive, a rotary table, or any other tool sufficient to provide rotation to the work string. In another embodiment, the downhole assembly may also include a motor, such as a mud motor 115 for actuating the rotary cutter assembly 105. The rotary cutter assembly 105 includes a plurality of blades 110 which are used to cut the casing 30. The blades 110 are movable between a retracted position and an extended position. In another embodiment, the tool 100 may use an abrasive cutting device to cut the casing instead of the rotary cutter assembly 105. The abrasive cutting device may include a high pressure nozzle configured to output high pressure fluid to cut the casing. In another embodiment, the tool 100 may use a high energy source such as laser, high power light, or plasma to cut the casing. Suitable cutting system may use well fluids, and/or water to cut through multiple casings, cement, and voids.

Figure 3:
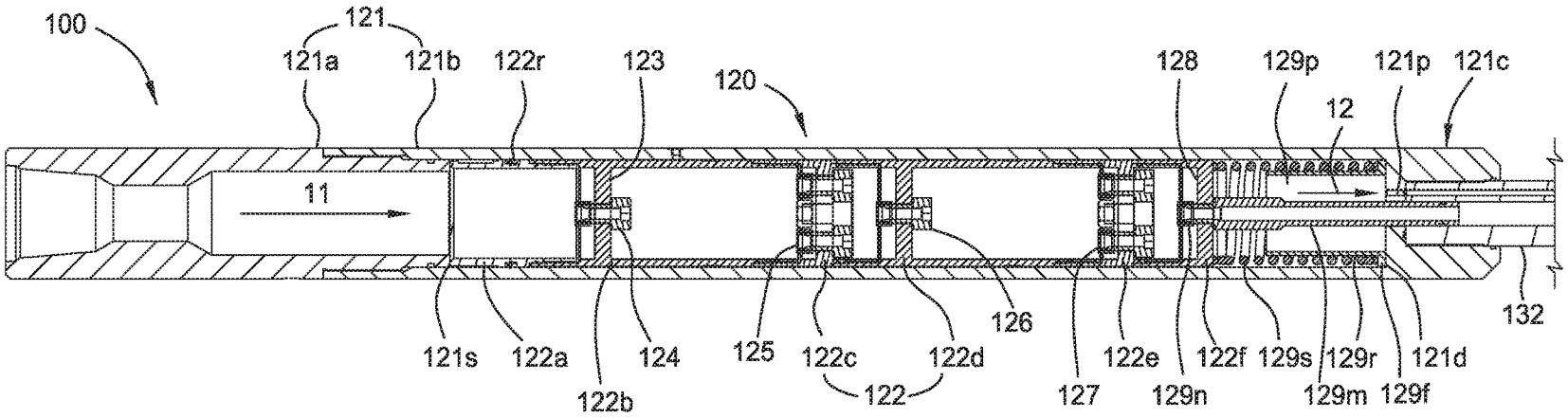
FIG. 3 is a cross sectional view of the pressure modification assembly of the downhole casing tool.

FIG. 3 illustrates the PMA 120 of the downhole casing tool 100. The pressure modification assembly 120 may include a housing 121, a piston assembly 122, a piston chamber 129*p*, a biasing member, such as spring 129*s*, a retainer 129*r*, and a mandrel 129*m*. The housing 121 may be tubular and have a longitudinal bore formed therethrough. The housing 121 may include two or more tubular sections 121*a,b*. Housing section 121*a* may have couplings, such as threaded couplings, formed at longitudinal ends thereof for connection to the work string at an upper end and the housing section 121*b* at a lower end. The housing section 121*a* may have a shoulder 121*s* formed at a lower end thereof. Housing section 121*b* may have couplings, such as threaded couplings, formed at longitudinal ends thereof for connection to the housing section 121*a* at an upper end and a guide mandrel 132 at a lower end. The housing section 121*b* may have a cap 121*c* formed at a lower end thereof. The cap 121*c* may be integrally formed with the housing section 121*b*. The cap 121*c* may have an inner recess for receiving the guide mandrel 132. An inner surface of the cap 121*c* may be threaded for longitudinally connecting the guide mandrel 132 to the housing 121. The cap 121*c* may have a shoulder 121*d* formed at an upper end. The cap 121*c* may have a bore therethrough. The bore may be aligned with the inner recess of the cap 121*c*. The bore of the cap 121*c* may have a smaller diameter than the inner recess of the cap 121*c*. The bore may be configured to slidably receive a mandrel 129*m* of the piston assembly 122. A port 121*p* may be formed through a wall of the housing section 121*b*. The port 121*p* may be formed through a wall of the cap 121*c*. The port 121*p* may be in fluid communication with the piston chamber 129*p*.

The piston assembly 122 may be tubular and have a longitudinal bore formed therethrough. The piston assembly 122 may be disposed in the housing 121 and longitudinally movable relative thereto between a rest position (FIG. 3), a slip setting position, and a packer setting position. The piston 122 may include two or more tubular sections 122*a-f* connected to each other, such as by threaded couplings. An inner diameter of the piston assembly 122 may be uniform throughout the piston sections 122*a-f*. The piston section 122*a* may be tubular having a bore therethrough. A recess 122*r* may be formed in a wall of the piston section 122*a*. A seal may be disposed in the recess 122*r* for sealing against an inner surface of the housing section 121*b*. The piston section 122*a* may have a coupling formed at a longitudinal end thereof for coupling to the piston section 122*b*. The piston section 122*a* may have a shoulder formed at a longitudinal end opposite the coupling. The shoulder of the piston section 122*a* may engage the shoulder 121*s* of the housing section 121*a* when the piston assembly 122 is in the rest position. Piston section 122*b* may be tubular having a bore extending at least partially therethrough. Piston section 122*b* may have a wall 123 formed perpendicular to the bore. The wall 123 may longitudinally divide the piston section 122*b* into an upper portion and a lower portion. The lower portion may be larger than the upper portion. One or more flow paths, such as nozzle 124, may be formed through the wall 123. The nozzle 124 may have a bore therethrough. An inner diameter of the nozzle 124 may be smaller than an inner diameter of the piston sections 122*a,b*. The one or more flow paths may provide fluid communication between the upper portion and the lower portion of the piston section 122*b*. Piston section 122*b* may have couplings, such as threaded couplings, at longitudinal ends thereof for coupling to the piston section 122*a* at an upper end and for coupling to the piston section 122*c* at a lower end.

Piston section 122*c* may be tubular having a bore extending at least partially therethrough. Piston section 122*c* may have a wall formed perpendicular to the bore. The wall may longitudinally divide the piston section 122*c* into an upper portion and a lower portion. An exit of the nozzle 124 may direct fluid towards the wall of the piston section 122*c*. One or more flow paths, such as nozzles 125 (three shown), may be formed through the wall. The nozzles 125 may have a bore therethrough. Inner diameters of the nozzles 125 may be smaller than an inner diameter of the piston section 122*c*. The one or more flow paths may provide fluid communication between the upper portion and the lower portion of the piston section 122*c*. Each of the nozzles 125 may be longitudinally misaligned with the nozzle 124.

Piston section 122*d* may be tubular having a bore extending at least partially therethrough. Piston section 122*d* may have a wall formed perpendicular to the bore. The wall may longitudinally divide the piston section 122*d* into an upper portion and a lower portion. The lower portion may be larger than the upper portion. An exit of the nozzles 125 may direct fluid towards the wall of the piston section 122*d*. One or more flow paths, such as nozzle 126, may be formed through the wall. The nozzle 126 may have a bore therethrough. An inner diameter of the nozzle 126 may be smaller than an inner diameter of the piston section 122*d*. The one or more flow paths may provide fluid communication between the upper portion and the lower portion of the piston section 122*d*. The nozzle 126 may be longitudinally misaligned with each of the nozzles 125. The nozzle 126 may be longitudinally aligned with the nozzle 124.

Piston section 122*e* may be tubular having a bore extending at least partially therethrough. Piston section 122*e* may have a wall formed perpendicular to the bore. The wall may longitudinally divide the piston section 122*e* into an upper portion and a lower portion. An exit of the nozzle 126 may direct fluid towards the wall of the piston section 122*e*. One or more flow paths, such as nozzles 127 (three shown), may be formed through the wall. An inner diameter of the nozzles 127 may be smaller than an inner diameter of the piston section 122*e*. The one or more flow paths may provide fluid communication between the upper portion and the lower portion of the piston section 122*e*. Each of the one or more nozzles 127 may be longitudinally misaligned with the nozzle 126.

Piston section 122*f* may be tubular having a bore extending at least partially therethrough. Piston section 122*f* may have a wall 128 formed at a longitudinal end thereof. The wall 128 may rest on an upper end of the spring 129*s*. The wall may separate the bore of the piston section 122*f* from the piston chamber 129*p*. An exit of the nozzles 127 may direct fluid towards the wall of the piston section 122*f*. One or more flow paths, such as nozzle 129*n*, may be formed through the wall of the piston section 122*f*. An exit of the nozzle 129*n* may be coupled to the piston mandrel 129*m*. The nozzle 129*n* may provide fluid communication between the piston section 122*f* and the piston mandrel 129*m*. The nozzle 129*n* may be longitudinally misaligned with each of the nozzles 127. The piston 122 and piston mandrel 129*m* may be longitudinally movable relative to the housing 121.

The piston chamber 129*p* may be formed in the bore of the housing. The piston chamber 129*p* may be disposed between the wall 128 of the piston section 122*f* and the cap 121*c* of the housing section 121*b*. The piston chamber 129*p* may be in fluid communication with the port 121*p*. A retainer 129*r* may be disposed in the piston chamber 129*p*. The retainer 129*r* may be tubular and have a longitudinal bore formed therethrough. The piston mandrel 129*m* may extend through the bore of the retainer 129*r*. A lower end of the retainer 129*r* may rest against the cap 121*c* of the housing section 121*b*. The retainer 129*r* may have a flange 129*f* formed at a lower end. A lower end of the spring 129*s* may rest on the flange 129*f*. The spring 129*s* may bias the piston 122 towards the rest position.

The mandrel 129*m* may be tubular and have a longitudinal bore formed therethrough. The mandrel 129*m* may be disposed in the housing section 121*b* and longitudinally movable relative thereto. The mandrel 129*m* may have a coupling, such as a threaded coupling, formed at a longitudinal end thereof for connection to the piston section 122*f*. The piston mandrel 129*m* may be slidably received in the guide mandrel 132. An outer surface of the piston mandrel 129*m* may have a recess configured to receive an o-ring seal. The o-ring may seal against an inner surface of the bore of the guide mandrel 132.

Figure 4:
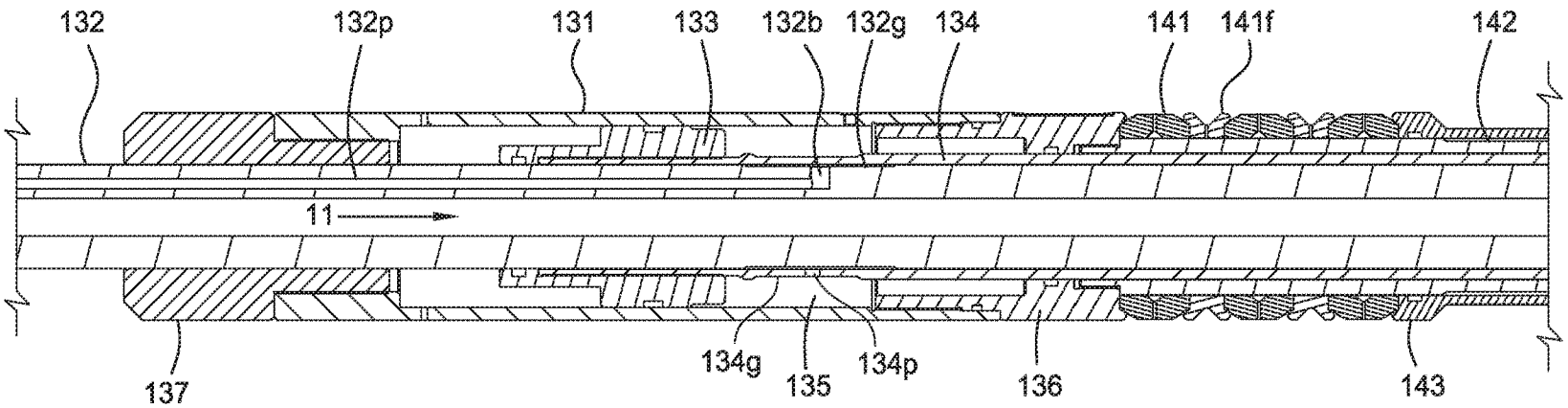
FIG. 4 is a cross sectional view of the actuator and packer assembly of the downhole casing tool.

FIG. 4 illustrates a middle portion of the tool 100, including the actuator 130 and packer assembly 140. The actuator 130 may include a housing 131, a guide mandrel 132, a slip piston 133, a drive mandrel 134, an actuation chamber 135, a packer piston 136, and a bearing, such as sleeve bearing 137. The housing 131 may be tubular and have a longitudinal bore formed therethrough configured to receive the guide mandrel 132. The housing 131 may have couplings, such as threaded coupling, formed at longitudinal ends thereof for connection to the sleeve bearing 137 at an upper end at for connection to the packer piston 136 at a lower end thereof. The housing 131 may be longitudinally movable relative to the guide mandrel 132. The sleeve bearing 137 may be a brass bearing. The sleeve bearing 137 may be tubular having a bore therethrough configured to receive the guide mandrel 132. The sleeve bearing 137 may be longitudinally movable relative to the guide mandrel 132. The sleeve bearing 137 may facilitate longitudinal movement of the housing 131 relative to the guide mandrel 132.

The guide mandrel 132 may be tubular and have a longitudinal bore formed therethrough. The guide mandrel 132 may be at least partially disposed in the bore of the actuator housing 131. The guide mandrel 132 may have couplings, such as threaded couplings, formed at each longitudinal end thereof for connection to the PMA housing 121 at an upper end thereof and an adapter housing 171 at a lower end thereof. The bore of the guide mandrel 132 may be in fluid communication with the piston mandrel 129*m* at an upper end thereof and with the adapter housing 171 at a lower end thereof. The piston mandrel 129*m* may be at least partially disposed in the guide mandrel 132 and longitudinally movable relative thereto. A bypass passage 132*p* may be formed in a wall of the guide mandrel 132. The bypass passage 132*p* may be formed at least partially longitudinally through the guide mandrel 132. An upper end of the bypass passage 132*p* may be in fluid communication with the piston chamber 129*p* via the port 121*p*. A lower end of the bypass passage 132*p* may be in fluid communication with a bypass port 132*b*. A groove 132*g* may be formed along an outer surface of the guide mandrel 132. The bypass port 132*b* may terminate at the groove 132*g*.

The slip piston 133 may be disposed in the housing 131 and longitudinally movable relative thereto. The slip piston 133 may be tubular and have a longitudinal bore formed therethrough for receiving the guide mandrel 132. The slip piston 133 may be disposed on an outer surface of the guide mandrel 132 and longitudinally movable relative thereto. The slip piston 133 may have an annular flange at a lower end thereof. An upper recess and a lower recess may be formed in the slip piston 133 and receive upper and lower seals. Upper seal may seal against an outer surface of the guide mandrel 132. Lower seal may seal against an inner surface of the housing 131. The slip piston 133 may be disposed around a circumference of the drive mandrel 134. The slip piston 133 may have a coupling, such as a threaded coupling, formed along an inner surface thereof for connection to the drive mandrel 134.

The drive mandrel 134 may be tubular and have a longitudinal bore formed therethrough for receiving the guide mandrel 132. The drive mandrel 134 may be disposed about a circumference of the guide mandrel 132 and longitudinally movable relative thereto via the slip piston 133. The drive mandrel 134 may be disposed in the housing 131 and longitudinally movable relative thereto via the slip piston 133. The drive mandrel 134 may have couplings, such as threaded couplings, formed at each longitudinal end thereof for connection to the slip piston 133 at an upper end thereof and a connector mandrel 172 at a lower end thereof. A mandrel port 134*p* may be formed through a wall of the drive mandrel 134 adjacent the groove 132*g*. The mandrel port 134*p* may be in fluid communication with the bypass port 132*b* via the groove 132*g*.

The actuation chamber 135 may be an annulus formed between the drive mandrel 134 and the housing 131. The actuation chamber 135 may be formed longitudinally between the slip piston 133 and the packer piston 136. The actuation chamber 135 may be in fluid communication with the bypass passage 132*p* via the drive mandrel port 134*p*. A port in the housing 131 may be opened to fill the actuation chamber 135 and piston chamber 129 with fluid before lowering the tool 100 to the well.

The packer piston 136 may be tubular having a bore therethrough configured to receive the guide mandrel 132. The packer piston 136 may be disposed at a lower end of the housing 131 and longitudinally movable relative to the guide mandrel 132. An upper recess and a lower recess may be formed in the packer piston 136 and receive upper and lower seals. Upper seal may seal against an inner surface of the housing 131. Lower seal may seal against an outer surface of the drive mandrel 134. The packer piston 136 may include a flange having a coupling on an outer surface thereof for coupling to the housing 131. The packer piston 136 may include a shoulder having a coupling on an inner surface thereof for coupling to a packer mandrel 142.

The packer assembly 140 may include one or more packing elements 141, a packer mandrel 142, and a packer housing 143. The one or more packing elements 141 (three shown) may be annular. The one or more packing elements 141 may be disposed on an outer surface of the packer mandrel 142. The one or more packing elements 141 may be made from an elastomeric material. The one or more packing elements 141 may be disposed between a lower end of the packer piston 136 and an upper end of the packer housing 143. One or more annular flanges 141*f* may be disposed between the packing elements 141. The one or more annular flanges 141*f* may be disposed on the outer surface of the packer mandrel 142. The one or more packing elements 141 may be movable between a set position and an unset position (FIG. 4). The one or more packing elements 141 may be compressible between the packer piston 136 and the packer housing 143. The one or more packing elements 141 may be movable to an outwardly extended or set position, wherein the one or more packing elements 141 seals against an inner diameter of the casing string.

The packer mandrel 142 may be tubular and have a longitudinal bore formed therethrough. Packer mandrel 142 may have a coupling, such as a threaded coupling, formed at a longitudinal end thereof for connection to the packer piston 136. Packer mandrel 142 may be disposed on an outer surface of the drive mandrel 134. The packer mandrel 142 may be longitudinally movable with the packer piston 136 and relative to the guide mandrel 132. The packer housing 143 may be tubular having a longitudinal bore formed therethrough. The packer housing 143 may have a coupling, such as a threaded coupling, formed at a lower end thereof for connection to a connector mandrel 153. The packer mandrel 142 may be at least partially disposed within the packer housing 143. The packer mandrel may have a receiver at an upper end thereof for supporting one of the one or more packing elements 141. An annulus 144 may be formed between an outer surface of the drive mandrel 134 and the inner surface of the packer housing 143. The packer mandrel 142 may be longitudinally movable within the annulus 144.

Figure 5:
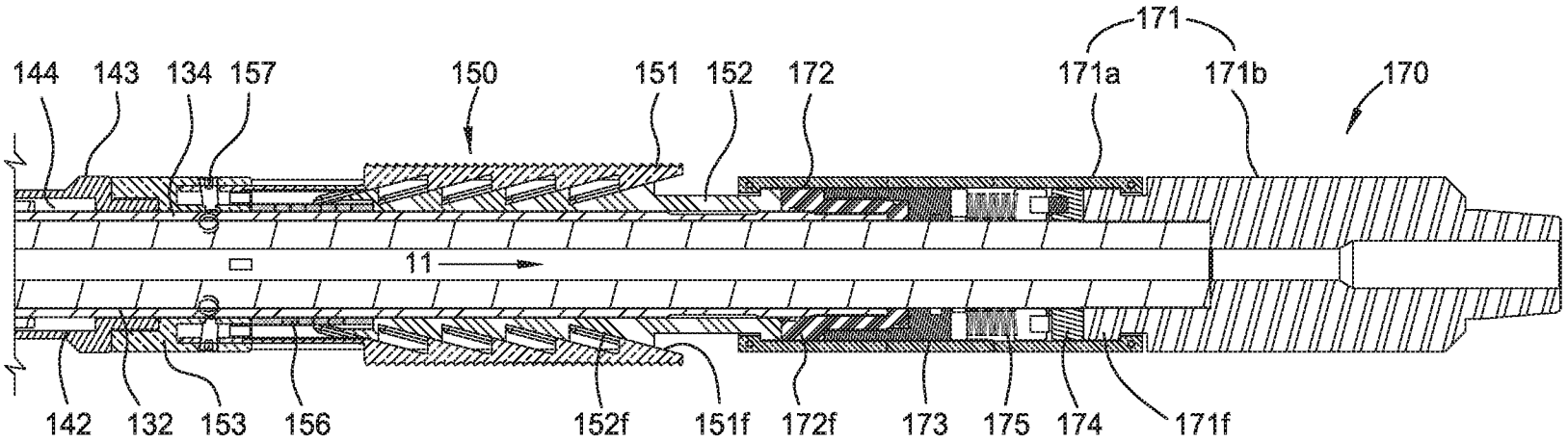
FIG. 5 is cross sectional view of the slip assembly and adapter of the downhole casing tool.

FIG. 5 illustrates a lower portion of the tool 100, including the slip assembly 150 and the adapter 170. The slip assembly 150 may include slips 151, a slip mandrel 152, a connector mandrel 153, a biasing member, such as spring 156, and a set pin 157. The slips 151 may be disposed about a circumference of the slip mandrel 152. The slips 151 may be radially movable between a set position (FIG. 5) and an unset position. The slips 151 may include tapered surfaces 151*f* along an inner surface thereof. An outer surface of the one or more slip elements 151 may include teeth configured to engage an inner surface of the casing 30 in the set position. The slips 151 may include an upper flange having a hole formed through a wall thereof. The hole may receive the set pin 156, longitudinally coupling the slips 151 to the connector mandrel 153. The hole may be configured to allow the slips 151 to extend and retract between the set position and unset position.

The slip mandrel 152 may be tubular and have a longitudinal bore formed therethrough. The slip mandrel 152 may have shoulders formed at a lower end thereof for connection to a housing section 171*a* and at an upper end thereof for retention of the spring 156. The slip mandrel 152 may be disposed about a circumference of the drive mandrel 134. The slip mandrel 152 may include tapered surfaces 152*f* corresponding to the tapered surfaces 151*f* of the slip 151. The slip mandrel 152 may be longitudinally movable between a first position (FIG. 5), wherein the slips 151 extend outward, and a second position, wherein the slips 151 retract inward to the unset position to rest along the tapered surfaces 152*f* of the slip mandrel 152.

Spring 156 may be disposed about a circumference of the drive mandrel 134. Spring 156 may be an annular spring. The spring 156 may be disposed between the connector mandrel 153 and the slip mandrel 152. Spring 156 may rest on the upper shoulder of the slip mandrel 152. Spring 156 may provide a biasing force against the longitudinal movement of the slip mandrel 152. The spring 156 may bias the slip mandrel 152 towards the second position, thereby biasing the slips 151 towards the unset position.

The adapter 170 may include a housing 171, a connector mandrel 172, one or more bearings 173, 174, and a biasing member, such as spring 175. The housing 171 may be tubular and have a longitudinal bore formed therethrough. The housing 171 may include two or more tubular sections 171*a,b* connected to each other, such as by threaded couplings. The housing section 171*a* may have shoulders formed at longitudinal ends thereof for connection to the slip mandrel 152 at an upper end thereof and housing section 171*b* at a lower end thereof. The housing section 171*b* may have couplings, such as threaded couplings, formed at longitudinal ends thereof for connection to the guide mandrel 132 at an upper end thereof and the downhole assembly at a lower end thereof. Housing section 171*b* may have a flange 171*f* formed at an upper end thereof for connection to the housing section 171*a*.

The connector mandrel 172 may be tubular and have a longitudinal bore formed therethrough. The connector mandrel 172 may have couplings, such as threaded couplings, formed along an inner surface thereof for connection to the drive mandrel 134 and an outer surface thereof for connection to the bearing 173. The connector 172 may be disposed in the housing 171. The connector 172 may have an annular flange 172*f* at an upper end thereof. The annular flange 172*f* may engage the lower shoulder of the slip mandrel 152. The connector 172 may be longitudinally movable relative to the housing 171 and the guide mandrel 132 via the connection to the drive mandrel 134.

The bearing 173 may be tubular and have a longitudinal bore formed therethrough. The bearing 173 may be a brass bearing. Bearing 173 may have a coupling, such as a threaded coupling, formed along an inner surface thereof for connection to the connector mandrel 172. The bearing 173 may have an annular flange at a lower end thereof. A recess may be formed along an inner surface of the annular flange. A seal may be disposed in the recess for sealing against the guide mandrel 132. The bearing 173 may be longitudinally movable relative to the housing 171 and the guide mandrel 132 via the connection to the connector mandrel 172. The bearing 173 may facilitate longitudinal movement of the drive mandrel 134 and connector mandrel 172 relative to the guide mandrel 132.

The bearing 174 may be disposed in the housing 171. The bearing 174 may be a polycrystalline diamond thrust bearing. The bearing 174 may support axial loads on the tool 100. The bearing 174 may facilitate rotation of the guide mandrel 132 and housing section 171*b* relative to the packer 140 and the slip assembly 150. The spring 175 may be disposed about the circumference of the guide mandrel 132. The spring 175 may be disposed in the housing section 171*a*. A lower end of the spring 175 may rest on the bearing 174. The spring 175 may protect the bearing 174 from an impact load by the tool 100. The spring 175 may provide a biasing force against the longitudinal movement of the drive mandrel 134.

In operation, fluid 11 is pumped down from the surface to the downhole casing tool 100. Fluid 11 travels down through the bore of the housing section 121*a* until reaching the piston section 122*a*. Fluid is prevented from traveling further through the bore of the housing 121 by the wall 123 of the piston section 122*b*. Instead, the fluid bypasses the wall 123 via the nozzle 124. Due to the smaller diameter of the nozzle 124 relative to the diameter of the piston section 122*a*, a velocity of the fluid is increased as the fluid passes through the nozzle 124. The exit of the nozzle 124 is directed towards the wall of the piston section 122*c*. Fluid exiting the nozzle 124 enters the lower portion of the piston section 122*b* and impacts the wall of the piston section 122*c*. The impact of the fluid transfers kinetic energy from the fluid to the piston 122. The impact of the fluid against the wall of the piston section 122*c* creates a longitudinal force to move the piston 122. The longitudinal force causes the piston 122 to move longitudinally relative to the housing 121. As a result of the loss of kinetic energy from the fluid, the pressure of the fluid drops.

Fluid 11 within the lower portion of the piston section 122*b* is prevented from traveling further through the downhole casing tool 100 by the wall of the piston section 122*c*. Fluid bypasses the wall by entering the one or more nozzles 125 and exiting into the lower portion of the piston section 122*c* below the wall. The fluid exiting the one or more nozzles 125 impacts the wall of the piston section 122*d*, transferring kinetic energy from the fluid to the piston 122. The impact of the fluid against the wall of the piston section 122*d* creates additional longitudinal force to move the piston 122. The additional longitudinal force causes the piston 122 to move further longitudinally relative to the housing 121. Again, the fluid pressure drops as a result of the transfer of kinetic energy. The fluid in the upper portion of the piston section 122*d* is prevented from traveling further through the downhole casing tool 100 by the wall of the piston section 122*d*. Fluid bypasses the wall of the piston section 122*d* by entering the nozzle 126. Fluid exits the nozzle 126 into the lower portion of the piston section 122*d*. The nozzle 126 is directed towards the wall of the piston section 122*e*. Fluid exiting the nozzle 126 impacts the wall of the piston section 122*e* and transfers kinetic energy to the piston 122. The impact of the fluid against the wall of the piston section 122*e* creates additional longitudinal force to move the piston 122. The additional longitudinal force causes the piston assembly 122 to move further longitudinally relative to the housing 121. The fluid pressure drops as a result of the transfer of kinetic energy from the fluid to the piston assembly 122.

Fluid within the upper portion of the piston section 122*e* is prevented from traveling further through the downhole casing tool 100 by the wall of the piston section 122*e*. Fluid bypasses the wall of the piston section 122*e* by entering the one or more nozzles 127. Fluid exits the one or more nozzles into a bore of the piston section 122*f*. The one or more nozzles 127 are directed towards the wall of the piston section 122*f*. Fluid exiting the one or more nozzles 127 impacts the wall of the piston section 122*f* and transfers kinetic energy to the piston 122. The impact of the fluid against the wall of the piston section 122*f* creates additional longitudinal force to move the piston 122. The additional longitudinal force causes the piston 122 to move further longitudinally relative to the housing 121. The fluid pressure drops as a result of the transfer of kinetic energy from the fluid to the piston 122.

The transfer of kinetic energy from the fluid to the piston 122 causes the piston 122 to move longitudinally relative to the housing 121 and against the biasing force of the spring 129*s*. The movement of the piston 122 forces fluid in the piston chamber 129*p* through the port 121*p* of the housing 121. The fluid 12 travels through the bypass passage 132*p* of the guide mandrel 132. Fluid 12 exits the bypass passage 132*p* into the groove 134*g* of the drive mandrel 134. Fluid 12 enters the actuation chamber 135 via the port 134*p* of the drive mandrel 134. The pressure of the fluid 12 acts on a lower end of the annular flange of the slip piston 133. The pressure of the fluid 12 causes the slip piston 133 to move longitudinally relative to the guide mandrel 132. The drive mandrel 134 moves longitudinally with the slip piston 133 along the outer surface of the guide mandrel 132. Movement of the drive mandrel 134 causes the connector 172 to move longitudinally due to the coupling between the drive mandrel 134 and the connector 172. An upper shoulder of the connector 172 engages a lower end of the slip mandrel 152. The slip mandrel 152 moves longitudinally with the connector 172. The tapered surfaces 151*f* of the slips 151 move along the corresponding tapered surfaces 152*f* of the slip mandrel 152 as the slip mandrel 152 moves longitudinally. The tapered surface 152*f* of the slip mandrel 152 forces the slips 151 into the set position. The set pin 157 moves through the hole in the upper flange as the slips 151 are extended outward into the set position. In the set position, the slips 151 engage the inner surface of the casing string 30. The teeth on the slips 151 grip the inner surface of the casing string 30 and longitudinally couple the casing string 30 and the downhole casing pulling tool 100.

The connection between the casing string 30 and the downhole casing pulling tool 100 may be tested by pulling up on the downhole casing pulling tool 100 at the surface. A top drive or other traveling member may be operated to lift the downhole casing pulling tool 100 and ensure the slips 151 longitudinally couple the tool 100 to the casing string 30.

Next, the downhole assembly is operated to cut the casing string 30. The traveling member or top drive begins rotating the work string. The housing 121 is rotated via the coupling to the work string. The rotation is transferred to the guide mandrel 132 via the coupling to the housing 121. The guide mandrel 132 is rotated relative to the actuator 130, packer 140, and slip assembly 150. Rotation is transferred to the adapter housing section 171*b* via the coupling to the guide mandrel 132. Rotation of the downhole casing pulling tool 100 is transferred to the downhole assembly to perform an operation in the well. For example, rotation of the adapter housing section 171*b* is transferred to the rotary cutter assembly 105 positioned adjacent the casing string 30. The rotary cutter assembly 105 continues to operate until a lower portion of the casing string 30 is disconnected from an upper portion of the casing string. At this point, the rotary cutter assembly 105 is deactivated by stopping rotation of the work string. After the casing string 30 is cut, the downhole casing pulling tool 100 and the upper portion of the casing string 30 above the cut are lifted from the well by applying an upward force on the work string. The downhole casing pulling tool 100 and the upper portion of the casing string 30 are retrieved to the surface.

Alternatively, the downhole assembly is operated using a motor, such as the mud motor 115. After passing through the PMA, the fluid enters the nozzle 129*n* and passes through the bores of the mandrel 129*m* and guide mandrel 132. Fluid 11 continues through the downhole casing pulling tool 100 into the adapter housing section 171*b*. The fluid 11 exits the downhole casing pulling tool 100 and enters the downhole assembly via the coupling. The mud motor 115 is hydraulically operated by the fluid 11 passing through the downhole assembly. The mud motor 115 operates the rotary cutter assembly 105 to cut the casing string 30. The rotary cutter assembly 105 continues to operate until a lower portion of the casing string 30 is disconnected from an upper portion of the casing string 30. At this point, the rotary cutter assembly 105 is deactivated by stopping pumping fluid 11 down the work string. After the casing string 30 is cut, the downhole casing pulling tool 100 and the upper portion of the casing string 30 above the cut are lifted from the well by applying an upward force on the work string. The downhole casing pulling tool 100 and the upper portion of the casing string 30 are retrieved to the surface.

In some instances, the upper portion of the casing string 30 may be stuck in the well after cutting. The packer assembly 140 is operated to isolate an annulus in the casing string 30 and assist in removal of the tool 100 and the cut portion of the casing string 30 from the well. The flowrate of the fluid in the work string is increased. The flowrate of the fluid may be increased to 300 gallons per minute. The increase in flowrate of the fluid increases the impact force acting on the piston assembly 122. The piston assembly 122 moves longitudinally relative to the housing 121 and pushes fluid out of the piston chamber 129*p* into the actuation chamber 135 via the bypass passage 132*p*. Since the slips 151 are engaged with the inner diameter of the casing string 30, the slip piston 133 is prevented from further longitudinal movement relative to the guide mandrel 132. The fluid 12 entering the actuation chamber 135 acts against a shoulder of the packer piston 136 to set the packer assembly 140. Movement of the packer piston 136 compresses the packer elements 141 between the packer piston 136, the separator rings 141*f*, and the packer mandrel 142. In the set position, the packer elements 141 extend outward and seal against an inner surface of the casing string 30. The packer assembly 140 isolates an annulus formed between the tool 100 and the inner diameter of the casing string 30. Fluid 11 exiting the downhole assembly flows back up the annulus between the tool 100 and the inner diameter of the casing string 30. The packer assembly 140 prevents the fluid from traveling further up the annulus towards the rig. The fluid pressure provides an additional upward force to assist in lifting the casing pulling tool 100 and upper portion of the casing string 30 from the well.

The downhole casing pulling tool 100 is resettable to perform another operation at a second location in the well. For instance, a second cut may be made to the casing string 30 at a second location in the well. Pumping of fluid through the downhole casing pulling tool is ceased. The spring 129*s* biases the piston assembly 122 away from the guide mandrel 132. The longitudinal movement of the piston assembly 122 relative to the housing 121 draws fluid back into the piston chamber 129*p*. The movement of the fluid 12 out of the actuation chamber 135 allows the packer elements 141 to decompress and move to an unset condition. In the unset condition, the seal is no longer formed between the packer assembly 140 and the inner diameter of the casing string 30. Once the packer assembly 140 is unset, a downward force is applied to the work string to unset the slips 151. The downward force causes the tapered surface 151*f* of the slips 151 to move along the corresponding tapered surface 152*f* of the slip mandrel 152. The slips 151 retract and move to the unset position. Once the slip assembly 150 and the packer assembly 140 are in the unset positions, the downhole casing pulling tool 100 is free to move longitudinally relative to the casing string 30 to a different location. For instance, the work string may be lifted by the top drive or traveling member to move the tool 100 to a second location above the first cut. The process described above is repeated to create a second cut in the casing string 30 at the new location. This process may be repeated as many times as necessary to allow for retrieval of the upper portion of the casing string 30.

In one embodiment, a downhole casing pulling tool includes a tubular housing having a bore therethrough, a packer assembly configured to isolate an annulus between a casing and the tool, a slip assembly configured to engage the casing, and a piston assembly disposed in the bore of the tubular housing. The piston assembly is configured to operate an actuator, wherein the actuator is configured to operate at least one of the packer assembly and the slip assembly and modify a fluid pressure in the bore of the tubular housing.

In one or more of the embodiments described herein, the piston assembly is longitudinally movable relative to the tubular housing.

In one or more of the embodiments described herein, the actuator includes an actuator housing having a bore therethrough, a guide mandrel at least partially disposed in a bore of the actuator housing, and a drive mandrel longitudinally movable relative to the actuator housing.

In one or more of the embodiments described herein, the actuator housing is longitudinally movable relative to the guide mandrel.

In one or more of the embodiments described herein, the actuator further includes a slip piston coupled to the drive mandrel and configured to actuate the slip assembly and a packer piston coupled to the actuator housing and configured to actuate the packer assembly.

In one or more of the embodiments described herein, the slip assembly includes a slip mandrel having a bore therethrough, at least one slip movable between an extended position and a retracted position along the slip mandrel, and biasing member configured to bias the at least one slip towards the retracted position.

In one or more of the embodiments described herein, the packer assembly includes a packer mandrel having a bore therethrough and at least one packing element disposed on the packer mandrel and movable to a set position, wherein the at least one packing element seals against the casing.

In one or more of the embodiments described herein, the fluid pressure is configured to operate a downhole assembly.

In one or more of the embodiments described herein, the downhole assembly includes a rotary cutter assembly.

In one embodiment, a method of performing an operation in a casing string includes deploying a tool in the casing string, wherein the tool is connected to a downhole assembly, pumping fluid through a bore of the tool to actuate a piston assembly, modifying a pressure of the fluid using the piston assembly, and operating the downhole assembly using the modified fluid pressure.

In one or more of the embodiments described herein, operating the downhole assembly includes cutting the casing string.

In one or more of the embodiments described herein, the method includes actuating a slip assembly of the tool to engage the casing string.

In one or more of the embodiments described herein, the method includes actuating a packer assembly of the tool to isolate an annulus between the casing string and the tool.

In one or more of the embodiments described herein, the method includes increasing the fluid pressure to actuate the packer assembly.

In one or more of the embodiments described herein, the method includes moving the tool longitudinally through the casing string and repeating the step of operating the downhole assembly using the modified fluid pressure.

In one or more of the embodiments described herein, the method includes retrieving the tool, the downhole assembly, and the cut casing string.

In one or more of the embodiments described herein, the method includes pumping fluid through the tool and into a lower portion of the annulus.

In one or more of the embodiments described herein, modifying a pressure of the fluid using the piston assembly comprises pumping the fluid through a series of nozzles.

In one embodiment, a downhole casing pulling tool includes a tubular mandrel having a bore therethrough and configured to connect to a downhole assembly, a packer assembly configured to isolate an annulus between a casing and the tool, a slip assembly configured to engage the casing, and a piston assembly configured to modify a pressure of fluid in the tubular mandrel.

In one or more of the embodiments described herein, the downhole assembly is operable using the modified fluid pressure.

While the foregoing is directed to embodiments of the present invention, other and further embodiments of the invention may be devised without departing from the basic scope thereof, and the scope thereof is determined by the claims that follow.

The invention claimed is:

1. A downhole casing pulling tool, comprising:
- a tubular housing having a bore therethrough;
- a packer assembly configured to isolate an annulus between a casing and the tool;
- a slip assembly configured to engage the casing;
- an actuator configured to actuate at least one of the packer assembly and the slip assembly, and
- a piston assembly disposed in the bore of the tubular housing, the piston assembly including:
  - a piston having a piston bore;
  - a first wall and a second wall axially spaced in the piston bore;
  - one or more first flow paths formed through the first wall; and
  - one or more second flow paths formed through the second wall;
- wherein the piston assembly is configured to:
  - operate the actuator; and
  - modify a fluid pressure in the bore of the tubular housing.

2. The tool of claim 1, wherein the piston assembly is longitudinally movable within the tubular housing.

3. The tool of claim 2, wherein the actuator includes an actuation chamber in fluid communication with a piston chamber disposed in the tubular housing, wherein the longitudinal movement of the piston assembly in a first direction transfers a fluid from the piston chamber to the actuation chamber to actuate the at least one of the packer assembly and the slip assembly.

4. The tool of claim 1, wherein the actuator comprises:
- an actuator housing having a bore therethrough;
- a guide mandrel at least partially disposed in the bore of the actuator housing; and
- a drive mandrel longitudinally movable relative to the actuator housing.

5. The tool of claim 4, wherein the actuator housing is longitudinally movable relative to the guide mandrel.

6. The tool of claim 4, wherein the actuator further comprises:
- a slip piston coupled to the drive mandrel and configured to actuate the slip assembly; and
- a packer piston coupled to the actuator housing and configured to actuate the packer assembly.

7. The tool of claim 1, wherein the slip assembly comprises:
- a slip mandrel having a bore therethrough;
- at least one slip movable between an extended position and a retracted position along the slip mandrel; and
- a biasing member configured to bias the at least one slip towards the retracted position.

8. The tool of claim 1, wherein the packer assembly comprises:
- a packer mandrel having a bore therethrough;
- at least one packing element disposed on the packer mandrel and movable to a set position, wherein the at least one packing element seals against the casing.

9. The tool of claim 1, wherein the fluid pressure is configured to operate a downhole assembly.

10. The tool of claim 9, wherein the downhole assembly comprises a rotary cutter assembly.

11. The tool of claim 1, wherein the actuator is configured to operate actuate the packer assembly and the slip assembly.

12. A method of performing an operation in a casing string, comprising:
- deploying a tool having a piston assembly in the casing string, wherein the tool is connected to a downhole assembly;
- pumping a fluid through a bore of the tool, thereby actuating the piston assembly;
- modifying a pressure of the fluid using the piston assembly; and
- operating the downhole assembly using the modified fluid pressure.

13. The method of claim 12, wherein operating the downhole assembly comprises cutting the casing string.

14. The method of claim 13, further comprising retrieving the tool, the downhole assembly, and the cut casing string.

15. The method of claim 12, further comprising actuating a slip assembly of the tool to engage the casing string.

16. The method of claim 12, further comprising actuating a packer assembly of the tool to isolate an annulus between the casing string and the tool.

17. The method of claim 16, further comprising increasing the pressure of a second fluid to actuate the packer assembly.

18. The method of claim 16, further comprising pumping the fluid through the tool and into a lower portion of the annulus.

19. The method of claim 12, further comprising:
- moving the tool longitudinally through the casing string;
- repeating the step of operating the downhole assembly using the modified fluid pressure.

20. The method of claim 12, wherein modifying the pressure of the fluid using the piston assembly comprises pumping the fluid through a series of nozzles.

21. The method of claim 12, wherein the piston assembly includes a piston having a piston bore, wherein a series of walls having one or more flow paths are disposed in the piston bore, and wherein modifying the pressure of the fluid using the piston assembly comprises pumping the fluid through the series of walls having the one or more flow paths.

22. A downhole casing pulling tool, comprising:
- an adapter having a bore therethrough and configured to connect to a downhole assembly;
- a packer assembly configured to isolate an annulus between a casing and the tool;
- a slip assembly configured to engage the casing; and
- a piston assembly disposed in a tubular housing and configured to move relative to the tubular housing, wherein the piston assembly is configured to modify a pressure of fluid, wherein the piston assembly comprises:
  - a piston having a sidewall defining a piston bore; and a plurality of dividing walls disposed within the piston bore, wherein each dividing wall has one or more flow paths formed therethrough, and wherein the one or more flow paths formed through each dividing wall are configured to maintain a fluid flow through the piston assembly as the piston assembly moves relative to the tubular housing.

23. The downhole casing pulling tool of claim 22, wherein the downhole assembly is operable using the modified fluid pressure.

24. A downhole casing pulling tool, comprising:

a packer assembly configured to isolate an annulus between a casing and the tool;

a slip assembly configured to engage the casing;

an actuator configured to actuate at least one of the packer assembly and the slip assembly, wherein the actuator comprises:

an actuator housing having a bore therethrough;

a guide mandrel at least partially disposed in the bore of the actuator housing, wherein the actuator housing is longitudinally movable relative to the guide mandrel; and a drive mandrel longitudinally movable relative to the actuator housing;

a tubular housing having a bore therethrough; and a piston assembly disposed in the bore of the tubular housing and configured to:

operate the actuator; and modify a fluid pressure in the bore of the tubular housing.

25. A downhole casing pulling tool, comprising:

a packer assembly configured to isolate an annulus between a casing and the tool;

a slip assembly configured to engage the casing;

an actuator, configured to actuate at least one of the packer assembly and the slip assembly, wherein the actuator comprises:

an actuator housing having a bore therethrough;

a guide mandrel at least partially disposed in the bore of the actuator housing;

a drive mandrel longitudinally movable relative to the actuator housing;

a slip piston coupled to the drive mandrel and configured to actuate the slip assembly; and a packer piston coupled to the actuator housing and configured to actuate the packer assembly;

a tubular housing having a bore therethrough; and a piston assembly disposed in the bore of the tubular housing and configured to:

operate the actuator; and modify a fluid pressure in the bore of the tubular housing.

* * * * *